US005299710A

United States Patent [19]

Welsch et al.

[11] Patent Number: 5,299,710

[45] Date of Patent: Apr. 5, 1994

[54] DRINK CONTAINER

[75] Inventors: Penny Welsch, Hawaiian Gardens; Salvador Roxas, Rancho Santa Margarita; Phillip Buck, Aliso Viejo; Carol J. Conner, Irvine; Gregory A. Marko, Costa Mesa, all of Calif.

[73] Assignee: Strottman International, Inc., Irvine, Calif.

[21] Appl. No.: 9,742

[22] Filed: Jan. 27, 1993

Related U.S. Application Data

[63] Continuation-in-part of Ser. No. 819, Oct. 26, 1992.

[51] Int. Cl.[5] ..... B65D 23/10

[52] U.S. Cl. ..... 220/675; 215/1 C; D9/528

[58] Field of Search ..... 215/1 C; 220/675; D9/528

[56] References Cited

U.S. PATENT DOCUMENTS

| | | | |
|---|---|---|---|
| D. 205,166 | 6/1966 | Price | D58/5 |
| D. 252,257 | 7/1979 | Dobbs et al. | D9/1 |
| D. 283,598 | 4/1986 | Heriard-Dubreuil | D9/405 |
| D. 284,641 | 7/1986 | Jones | D9/341 |
| D. 296,668 | 7/1988 | Stavish | D9/376 |
| D. 325,871 | 5/1992 | Hestehave et al. | D9/520 |
| 2,688,995 | 9/1954 | Wagoner | 150/0.5 |
| 2,837,245 | 6/1958 | Grebowiec | 222/184 |
| 3,176,879 | 4/1965 | Mojonnier | 222/143 |
| 3,214,052 | 10/1965 | Dike | 215/10 |
| 3,251,514 | 5/1966 | Speicher | 222/468 |
| 3,308,997 | 3/1967 | Kelly | 222/475 |
| 3,400,846 | 9/1968 | Kelly | 215/1 |
| 3,434,635 | 3/1969 | Mason, Jr. | 222/468 |
| 3,542,229 | 11/1970 | Bayeriein et al. | 215/1 |
| 3,708,082 | 1/1973 | Platte | 215/1 C |
| 3,746,200 | 7/1973 | Flider | 215/1 C X |
| 4,412,633 | 11/1983 | Guerrazzi et al. | 222/468 |
| 4,759,454 | 7/1988 | Nowicki et al. | 215/1 C X |
| 4,805,793 | 2/1989 | Brandt et al. | 215/1 C X |
| 4,923,098 | 5/1990 | Schoonover et al. | 215/1 C X |
| 4,969,922 | 11/1990 | Platte, Sr. | 215/1 C |
| 5,064,101 | 11/1991 | Richter et al. | 222/143 |
| 5,114,028 | 5/1992 | Ring | 215/1 C X |

FOREIGN PATENT DOCUMENTS 2042461A 9/1980 United Kingdom .

*Primary Examiner*—Steven M. Pollard
*Attorney, Agent, or Firm*—Richard C. Litman

[57] ABSTRACT

A container for liquids is disclosed. Overall, the container has a recessed portion extending across the top and a hollow handle overlying it. There is a raised hollow neck section, a raised hollow rear portion, and a handle that is integral, and in fluid connection, with both. The raised hollow neck section further includes a pour spout that is proximate a corner of the device, and the side wall juncture associated with this corner has a chamfer or beveled section that is configured to engage the activating lever or button of a conventional soft drink dispenser.

14 Claims, 6 Drawing Sheets

DRINK CONTAINER

CROSS REFERENCE TO RELATED APPLICATION

This is a continuation-in-part of Application Ser. No. 29/000,819, filed Oct. 26, 1992.

BACKGROUND OF THE INVENTION

1. Field of the Invention

The present invention relates to containers for liquids. More specifically, it relates to containers for dispensed soft drinks. Even more specifically, it relates to a polyethylene blowmolded container for soft drinks having a beveled or chamfered nose section located beneath the spout, adapted to engage the activation lever or button of a soft drink dispenser. The container also has a carrying handle and a spout adapted to receive a snap fit closure cover.

2. Description of the Prior Art

Patrons of fast food restaurants often order their food "to go". If soft drinks are included with this order, they generally come in cups with snap fit lids. This leads to a problem with the handling of these cups, especially if there are a number of them included in the order. Often, fold out cardboard trays with cavities to receive the cups are used. This generates an unnecessary amount of waste. One way to eliminate this problem would be to have a container that holds a number of servings and that allows the consumer to transport them easily when he leaves the establishment.

Another problem that arises when soft drinks are ordered to go is that they are almost always dispensed into inverted frustoconical cups. These types of containers have a high center of gravity and thus are prone to tipping over and spilling. One way to eliminate this problem would be to provide a container for beverages where the base was as wide as the top, to provide a more stable footing.

Containers that could be used in this capacity are well known in the art, and many patents have been issued for devices that could be adapted to this purpose.

The first patent in this discussion is U.S. Pat. No. Des. 205,166 issued on Jun. 28, 1966 to Warren L. Price. This discloses a jug that includes a central top handle and a recessed hand area with the pour mouth disposed centrally in a broad, flat, downwardly angled surface located anteriorly of the handle.

U.S. Pat. No. Des. 252,257 issued on Jul. 3, 1979 to Fred. R. Dobbs et al. shows a liquid container having a handle arranged diagonally on the top surface with a recessed area below it. The area, however, does not extend cleanly from side to side and it can be seen that Dobbs et al. lacks the beveled nose disposed under the pour spout.

Next in the discussion is U.S. Pat. No. Des. 283,598 issued on Apr. 29, 1986 to Francois M. P. Hériard-Dubreuil. This discloses a bottle with a recessed central portion, but is lacking the beveled nose or hollow handle of applicant's invention.

U.S. Pat. No. Des. 284,641 issued on Jul. 15, 1986 to David A. Jones discloses a jug with a recessed hand area and an overlying handle.

U.S. Pat. No. Des. 296,668 issued on Jul. 12, 1988 to Leonard J. Stavish and U.S. Pat. No. Des. 325,871 issued on May 5, 1992 to Borge Hestehave et al. both disclose laterally elongate liquid containers. They both show top pour mouths, central top handles, and recessed hand areas beneath the handles.

U.S. Pat. No. 4,412,633 issued on Nov. 1, 1983 to Vincent Guerrazzi et al. discloses a vented jug wherein a tubular hollow handle is connected to both the jug body and the collar that defines the upwardly open pour mouth.

Next is U.S. Pat. No. 4,805,793 issued on Feb. 21, 1989 to Charles M. Brandt et al. This shows a stackable bottle having a bottom surface bifurcated by a release groove to form a recessed portion on the bottom of the container. This release groove is interrupted by an external rib that fits into a notch means located on the anterior portion of the handle.

Another patent of interest is U.S. Pat. No. 4,923,098 issued May 8, 1990 to Michael I. Schoonover et al. wherein a fluid container includes a first and second top wall, each of which includes a handle and a first and second opening disposed, respectively, beneath them. Proximate each of these handles are caps that may include vents.

U.S. Pat. No. 5,064,101 issued on Nov. 12, 1991 to Simon J. Richter et al. discloses a container nestable with like configured containers. The container has a first and second opening, with the second opening having a conduit that extends from the top of the container downwards. This conduit is in fluid communication with the interior of the container and allows for the pumping of the contents out through the second opening when the first is attached to a quick disconnect coupling and, then, to a pump.

In U.S. Pat. No. 2,688,995 issued on Sep. 14, 1954 to Edmund L. Wagoner there is disclosed a liquid container for beer or the like. It teaches a one piece molded body, preferably made of polystyrene, with an upper end having a tapered throat, below which is an annular sealing groove that is adapted to receive a concavo-convex cover.

Next in this discussion is U.S. Pat. No. 2,837,245 issued on Jun. 3, 1958 to Michael J. Grebowiec. In this patent, a low pressure, flexible wall container is disclosed. The container has a neck portion, including a thicker portion for receiving neck sealing construction. The container also includes a dispensing head, a concave bottom including a circumferential groove indent, and a base piece.

Considered next is U.S. Pat. No. 3,176,879 issued on Apr. 6, 1965 to Albert B. Mojonnier. This patent teaches a container with a spout, a handle, and a depression in the bottom for stacking. The container is formed in two sections having mating outward flanges that also provide an integral handle. There are face panels, side panels, and end panels, the last two further including stiffening ribs. The spout is formed integrally with the top face panel and there is a depression in the bottom panel for receiving the spout of the container below when the units are stacked.

Another bottle construction is disclosed in U.S. Pat. No. 3,214,054 issued on Oct. 26, 1965 to Roy W. Dike. The bottle includes side wall means including panel indentations for receiving a label, bottom wall and top wall means. There is a dome shaped top member with an integral tubular handle having outwardly and downwardly flared end portions. These are connected to both the dome shaped member and the filling and pouring neck. The recess portions on the bottom wall extending diagonally between opposite side wall corners in combination with the handle members permits nesting when the devices are stacked.

A liquid dispensing jug having a vented handle is disclosed in U.S. Pat. No. 3,251,514 issued on May 17, 1966 to Wallace L. Speicher. The jug has a lower portion, an upper, tapered portion, an outlet spout, and a tubular handle. There is a shoulder in the outlet spout proximate the point where the tubular handle communicates with it. This shoulder causes liquid, when being poured, to move away from the entrance of the handle portion, allowing air to continuously flow therein, thus preventing pulsation and splashing.

There are two patents, both issued to Norman A. Kelly, discussed here. The first, U.S. Pat. No. 3,308,997 issued on Mar. 14, 1967 discloses a plastic jug where four side walls and a bottom wall define a substantially rectangular materials compartment. There are recessed portions to add strength and provide space for indicia located on the side walls, and a neck structure having a horizontal platform and a spout. There are four ribs integrally connected to the platform and the unit as a whole further includes a handle structure integrally connected between the neck structure and one of the side walls.

The second of the two is U.S. Pat. No. 3,400,846 issued on Sep. 10, 1968. In this disclosure a container has four side walls, a top wall, and a bottom wall that define a substantially rectangular chamber. There is further included an integral pouring spout with an irregularly shaped neck converging upwards towards a flange portion and a rear portion, the rear portion being substantially parallel with and rearward from the front wall. The flange portion communicates with the front end of a solid handle, and the rear end of the handle is secured to and integral with the top wall of the container.

Another container with a hollow handle is disclosed in U.S. Pat. No. 3,434,635 issued on Mar. 25, 1969 to Stanley I. Mason, Jr. There is a main body chamber, a spout, and a handle. The handle is hollow and is disposed in a generally vertical position. A recessed zone provides space for the handle within the outline of the chamber and a small passage, located proximate the juncture of the handle and the chamber, allows steady flow while pouring.

Another patent of interest is U.S. Pat. No. 3,542,229 issued on Nov. 24, 1970 to Ludwig Bayeriein et al. This discloses a plastic bottle with a shrunk strengthening band. Polyvinyl chloride is discussed as a material for the bottle, which has a neck and a base. A band, or multiple bands, which can be of varying widths, are heat shrunk around the bottle to pre-stress it.

The next piece of art in this discussion is British published application GB 2042461 A. The inventor was Henry F. Bowers and the date of publication was Sep. 24, 1980. The device has a conventional filling and pouring aperture, an eye to receive a separately molded carrying handle, and a central disk having a peripheral groove to allow the easy removal of the central disk, by cutting through the wall of the container at the groove.

Finally, U.S. Pat. No. 4,759,454 issued on Jul. 26, 1988 to Casimir W. Nowicki et al. discloses a hollow plastic bottle with a wrap around label. The container has a side wall including spaced shoulders that define the area to be covered by the label.

None of the above inventions and patents, taken either singly or in combination, is seen to describe the instant invention as claimed.

SUMMARY OF THE INVENTION

The present invention is a container for liquids. Overall, the container is formed with a recessed portion extending across the top and a hollow handle overlying it. There is a raised hollow neck section, a raised hollow rear portion, and a handle that is integral, and in fluid connection with both. The raised hollow neck section further includes a pour spout that is proximate an upper corner of the device, and the side wall juncture associated with this upper corner has a chamfered nose or beveled section that is configured to engage the activating lever or button on a soft drink dispenser.

Accordingly, it is a principal object of the invention to provide a container for liquids where the container fits easily under the dispensing throat of an existing soft drink dispensing machine and that has a chamfered nose or beveled surface to engage the activating lever or button on the dispenser.

It is another object of the invention to provide an alternative to the standard inverted frusto-conical soft drink containers that are commonly used in fast food restaurants for carry out, thus providing a lower center of gravity when the container is filled, i.e. less prone to tipping and spillage.

It is still another object of the invention to provide a container for soft drinks and the like that can hold a number of servings of a beverage, to allow these servings to be transported to the location where they are to be consumed while lowering the likelihood of accidental spillage.

It is yet a further object of this invention to provide a container for beverages such as soft drinks where, if the beverages are to be transported or held for any length of time, the container walls and bottom will not become saturated or soggy, thus maintaining structural integrity.

It is another object of this invention to provide a container for liquids where the beveled or chamfered nose is configured at such an angle as to position the fill spout underneath the dispensing nozzle when the bevel or chamfer is pressed against the activation lever or button of a conventional drink dispenser.

It is still yet another object of the invention to provide a container for liquids where the container is generally cubical allowing for both efficient use of space in shipping and maximizing the volume of liquid the container can hold and still include a carrying handle.

It is a further object of the invention to provide a container for liquids where the hollow handle, integral, and in fluid communication with both the hollow raised rear portion and the raised hollow neck section, allows the device to be filled with substantially no air bubbles left trapped under the top wall.

Still another object of the invention is to provide a container for liquids where a shrink wrapped or adhesively backed label can be placed about the side walls of the device while the fill level can be confirmed by the consumer.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
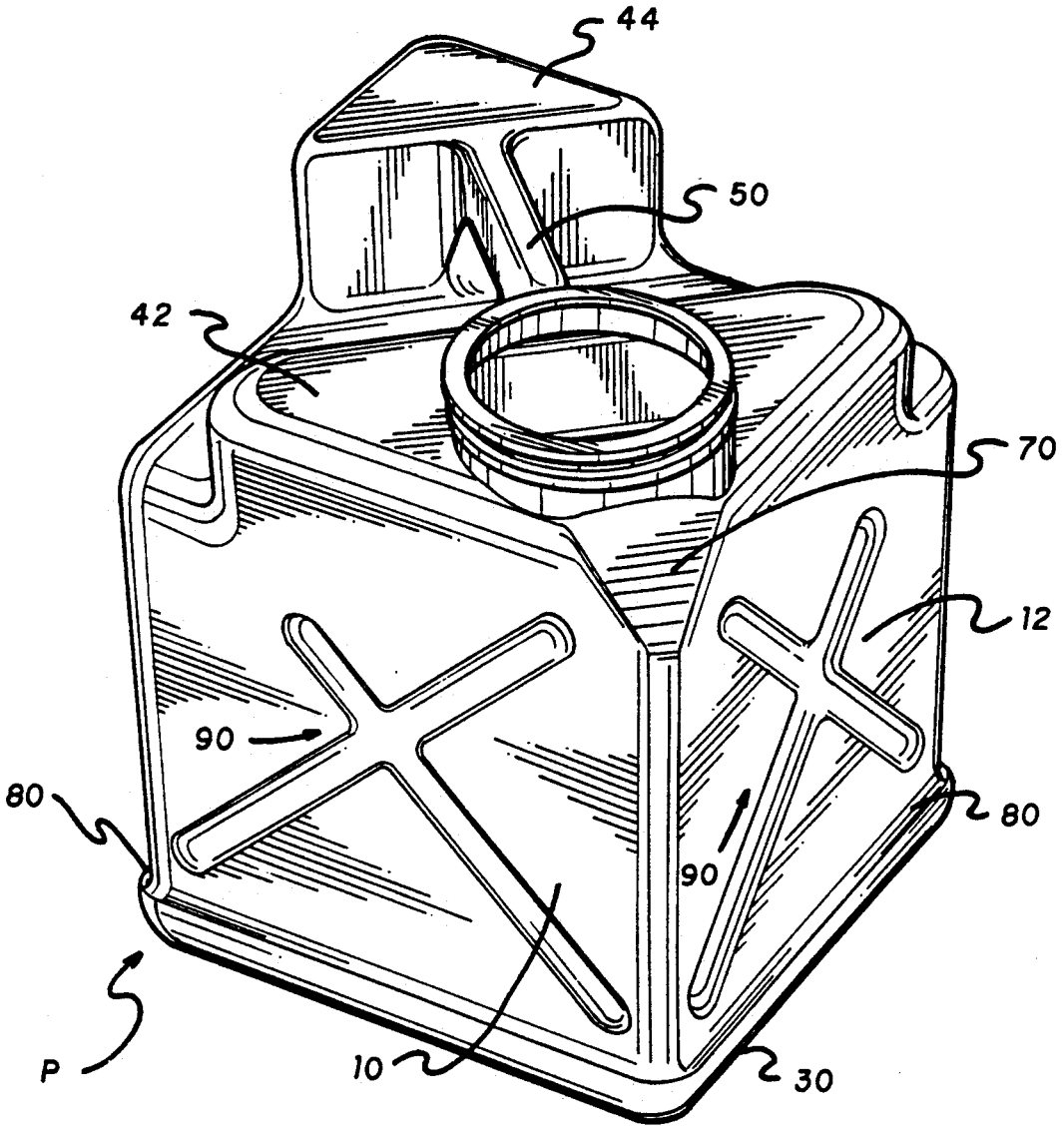
FIG. 1 is a front top perspective view of the first embodiment of the drink container.

Referring to FIGS. 1, 2, 3, and 4, the first embodiment of the invention is seen. The container P has four side walls, 10, 12, 14, and 16. These side walls meet at side wall junctures 20, 22, 24, 26 and form a side wall means which, in the embodiments discussed herein, has a generally cubical shape. It should be noted, however, that other shapes than the cubical embodiments shown here, could be utilized without departing from the spirit of the invention. One of the most important features of the present invention is seen at side wall juncture 20, which is the juncture proximate to the pour spout 52. This is a chamfer 70, that is designed to engage the activation lever or button A (shown in FIGS. 7 and 8) on a drink dispenser DD of the type commonly used in restaurants.

The container P also has a bottom wall 30 which is substantially flat, allowing the container P to be rested on a surface without tipping. The top wall 40 of the container P includes an open hollow raised neck section 42 and a hollow raised rear section 44. Integral to these, and in fluid communication with both, is a hollow handle portion 50. The arrows in FIG. 4 emphasize this communication. There is a pour spout 52 in the hollow raised neck section that further includes two raised rim rings 54, 56 to engage and retain the spout cap 58, shown in broken lines in FIGS. 2, 3, and 4. Lying underneath the handle is an open, recessed handle access area 60. This area is bounded by the handle bottom 62, the recessed area floor 64, the hollow raised neck section 42, and the hollow raised rear portion 44. The recessed area 60 provides room for the user to reach under and thus firmly grip the handle 50. The hollow handle, communicating between the raised rear portion 44 and the hollow neck section 42, allows the container P to be filled up with virtually no air space left in the container P, especially in the raised rear portion 44. If there were an air bubble left during the last stages of the filling process, simply tilting the device backwards slightly, i.e. raising the neck section 42, will cause the residual air to pass through the handle 50, into the neck section 42, and thus out from the spout 52.

In the first embodiment of the invention, there is a lower peripheral edge lip 80 that is present on the four side walls 10, 12, 14, 16. The lip 80 limits the initial downward travel of a paper, plastic, or shrink wrap plastic label (not shown) or the like while it was being placed around the side walls 10, 12, 14, 16. The label could be adhesively backed paper, plain paper, clear, translucent, or opaque plastic, or it could be a common shrink wrap type of plastic material. It could carry indicia, a logo, a fanciful design, or a combination of these. In the second embodiment of the invention, shown in FIG. 5, there is a second, upper peripheral edge lip 82 added to the side walls 10, 12, 14, 16 in addition to the lower lip 80. This would even further limit any unintended movement of the label after it is placed.

Figure 5:
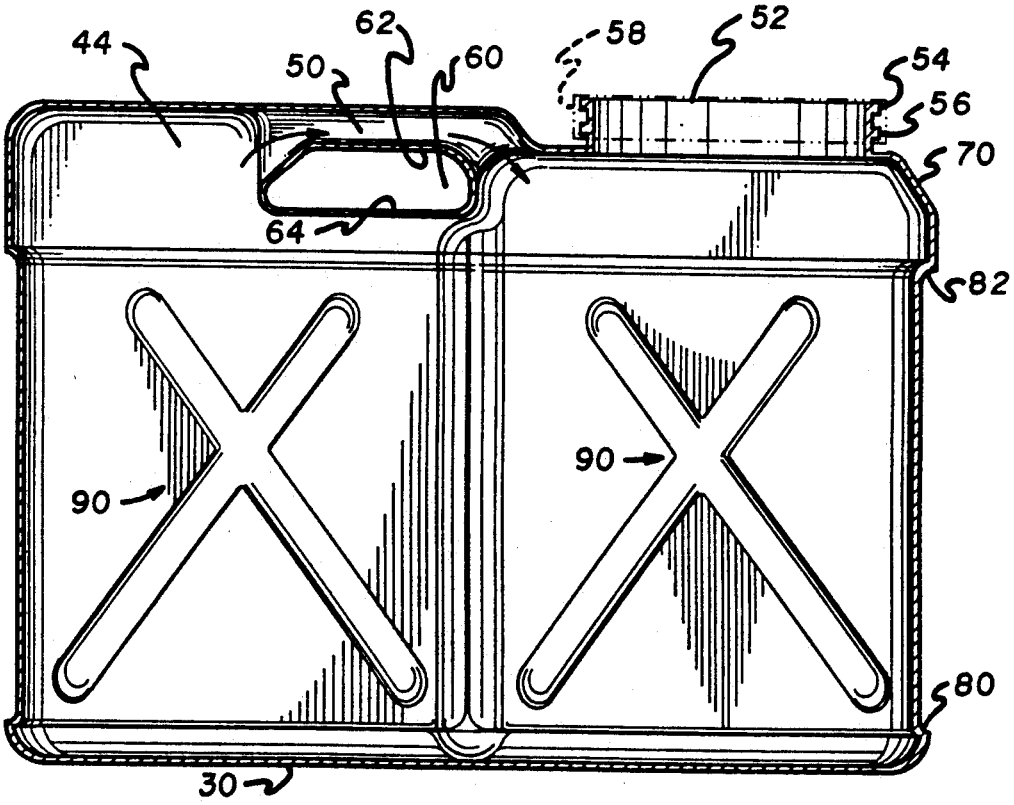
FIG. 5 is a cross sectional view similar to FIG. 4, but showing the second embodiment of the invention, this embodiment having an added upper lip extending about the side walls to define the label receiving area.

The arrows in this FIG. 5, as discussed above, emphasize the fluid communication in the handle 50 between the raised rear section 44 and the neck section 42.

Figure 6:
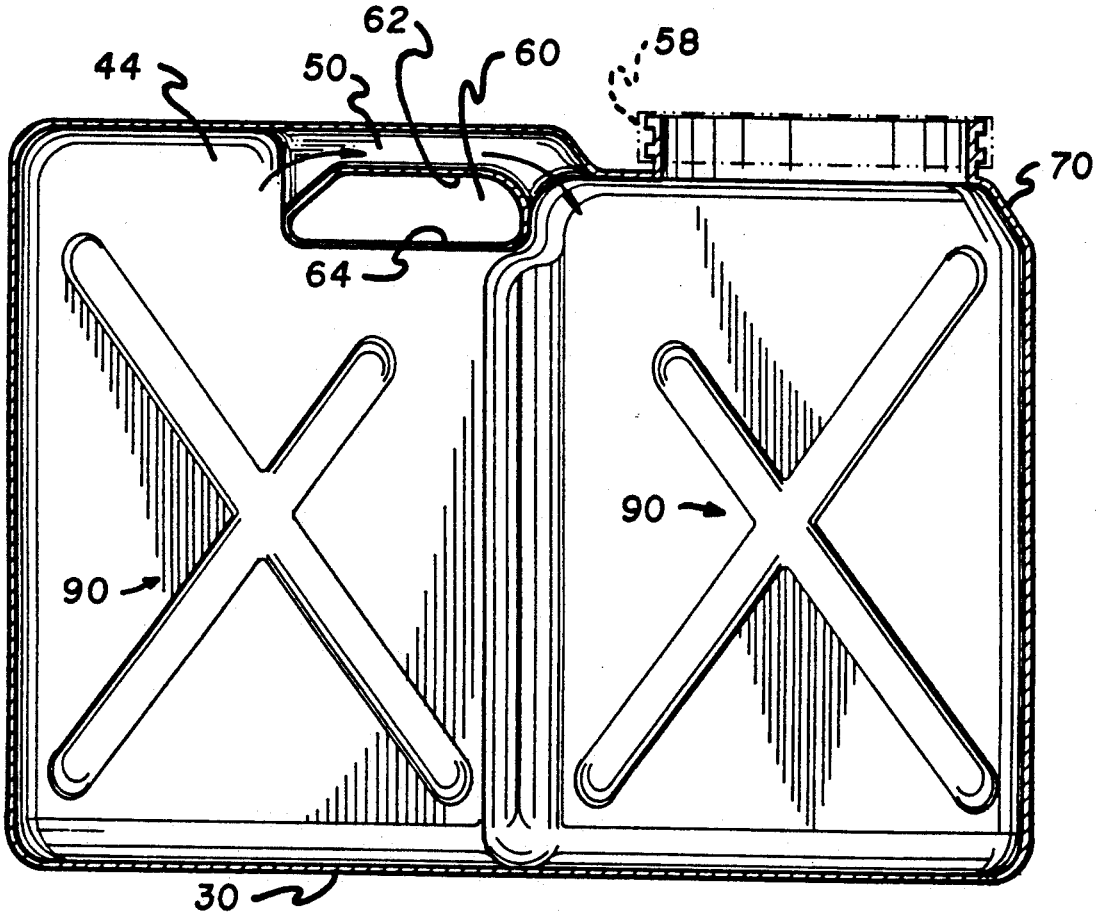
FIG. 6 is a cross sectional view similar to FIG. 4, but showing an embodiment of the invention wherein there is no lower lip extending about the side walls.

In the third embodiment of the invention, shown in FIG. 6, neither the upper lip 82 or the lower lip 80 are present. This embodiment would be applicable to a situation where the container P is to be placed in an outer sheath (not shown) made of a corrugated material, an insulator of some sort, or a thickened paper wrapper. As in the other two cross-sectional figures, the arrows are to emphasize the fluid communication within the handle 50 between the neck section 42 and the raised rear section 44.

With further reference to FIGS. 1 and 3–6, each of the vertical walls of the container P has an "X" configured depression 90 formed as a part of the wall material which is both decorative in nature and functional, in providing a pair of strengthening ribs within each of the walls 10, 12, 14, and 16.

Figure 2:
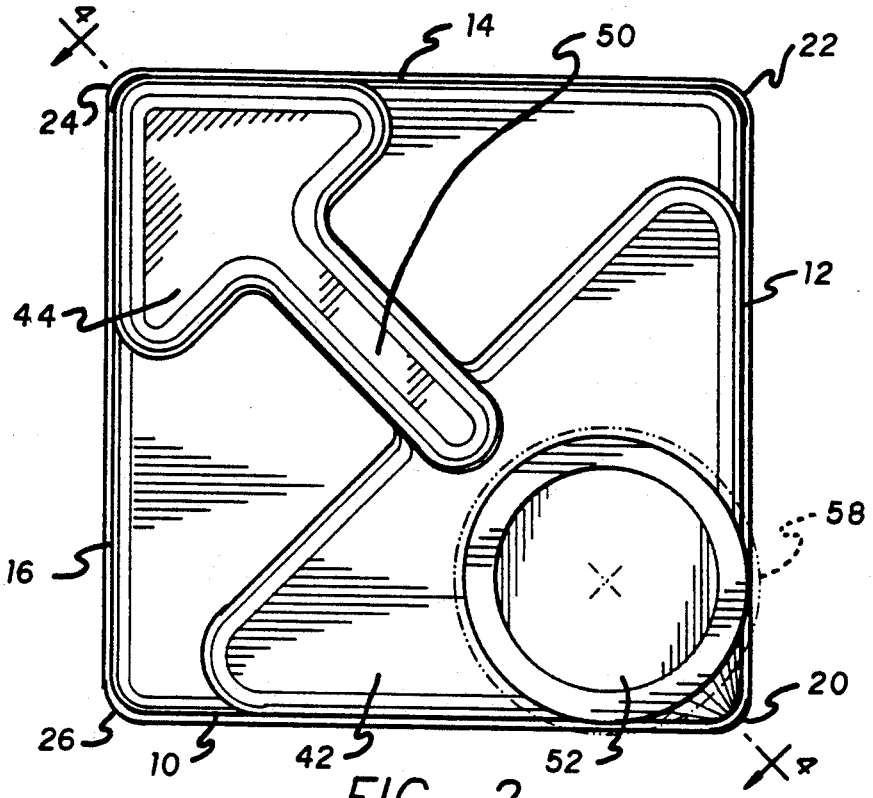
FIG. 2 is a top view of the drink container with broken lines showing the spout cap.
Figure 3:
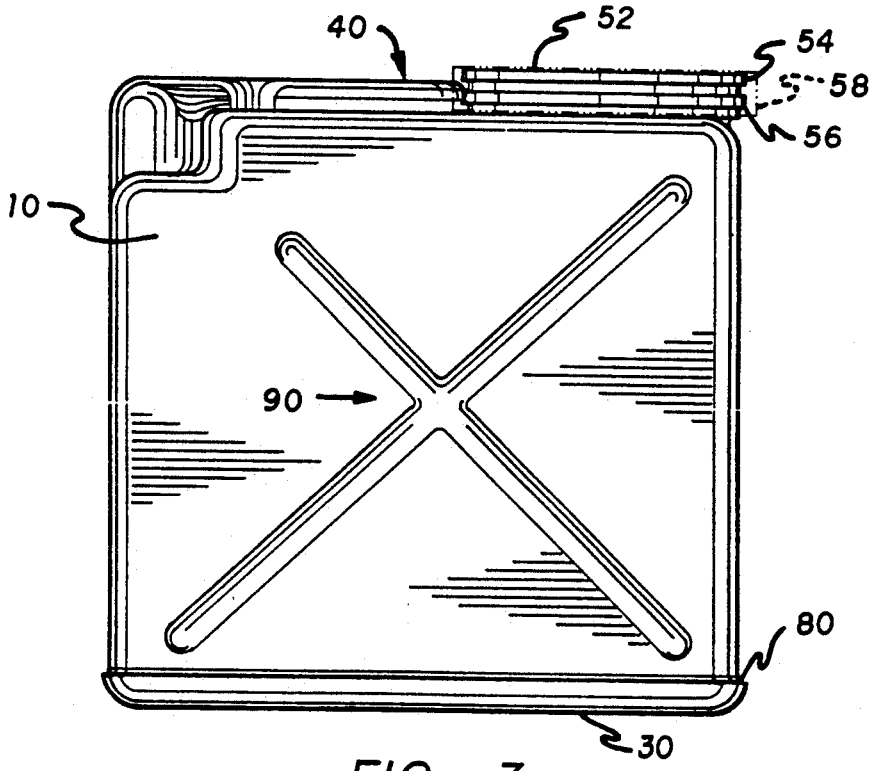
FIG. 3 is a front elevational view of the drink container with broken lines showing the spout cap.
Figure 4:
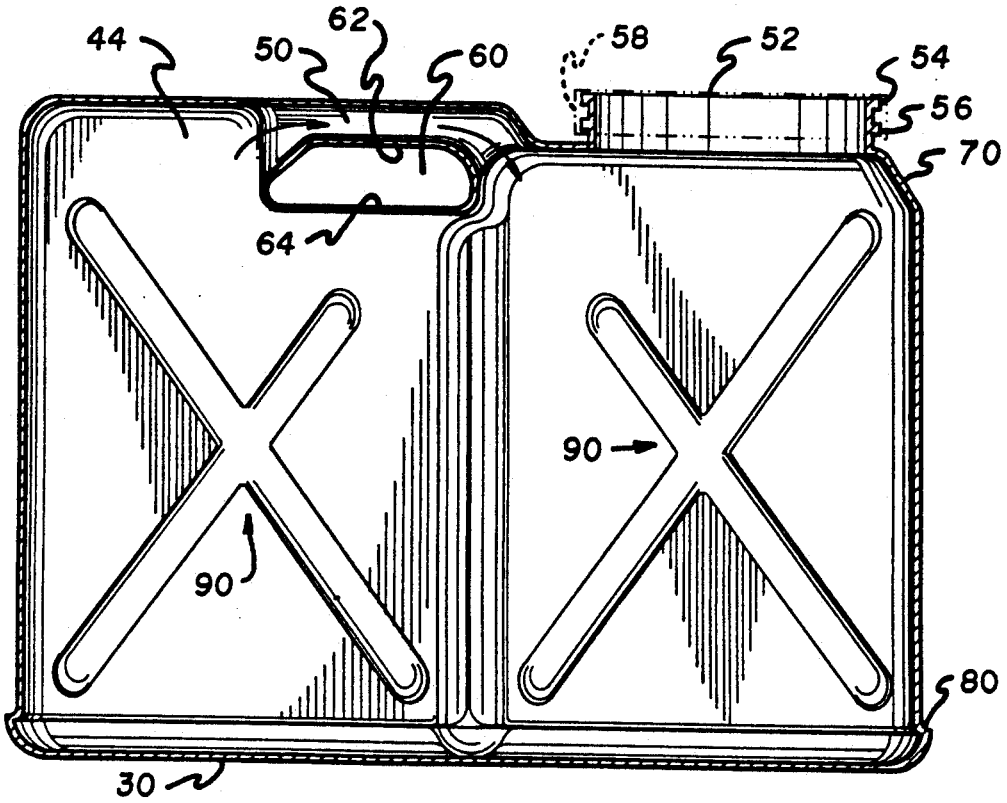
FIG. 4 is a cross sectional view taken along line 4—4 of FIG. 2.

The recessed area 60 beneath the hollow handle 50 is located adjacent to the center of the overall container P, as most clearly seen in FIG. 2, for ease in carrying the container P when filled with liquid. Furthermore, area 60 provides a convenient suspension point for temporary storage of a row of such containers P, as on an elongate pole or the like (not shown).

Figure 7:
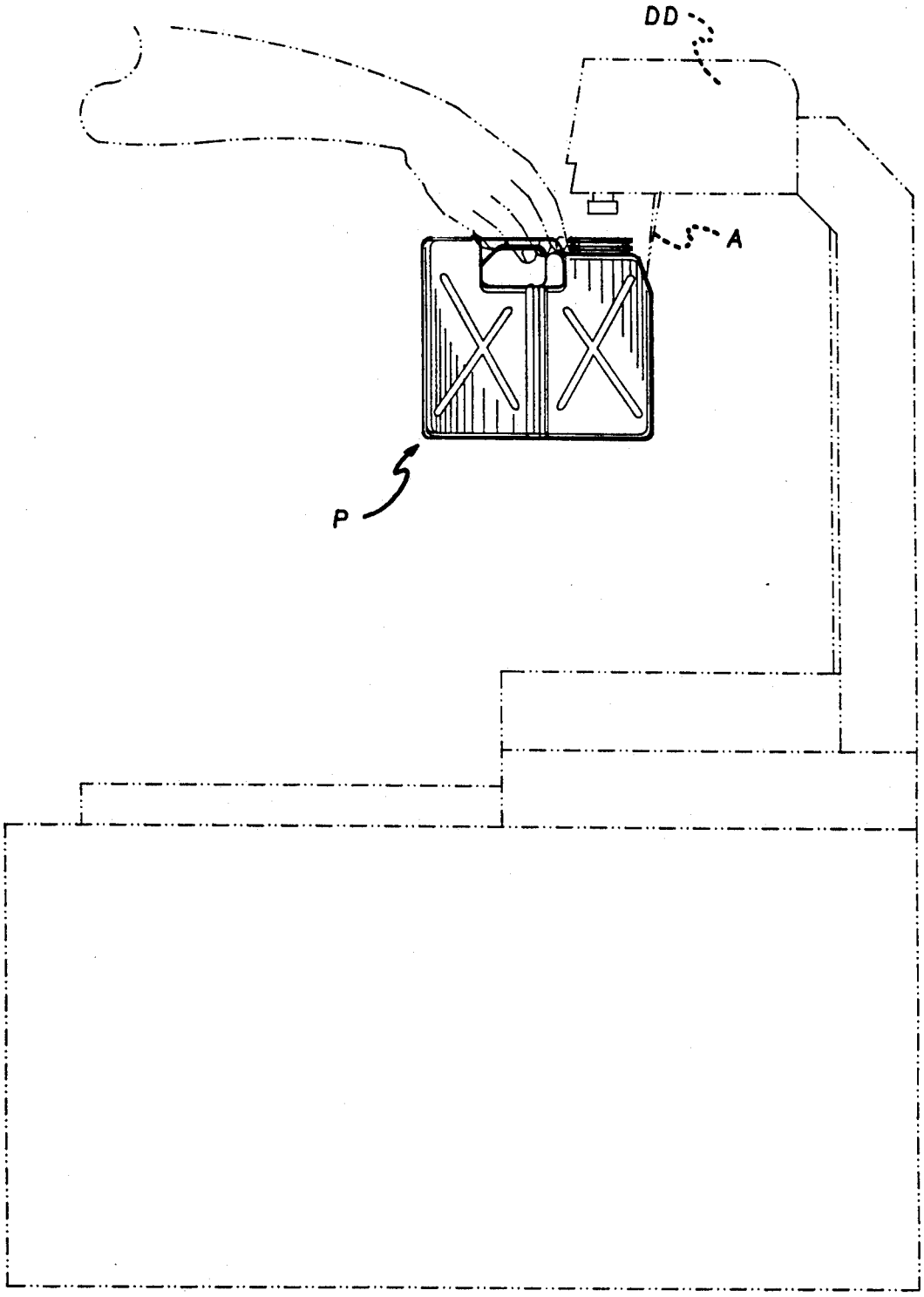
FIG. 7 is a side elevational view of the invention in use with an otherwise conventional drink dispenser, which is illustrated in phantom lines.
Figure 8:
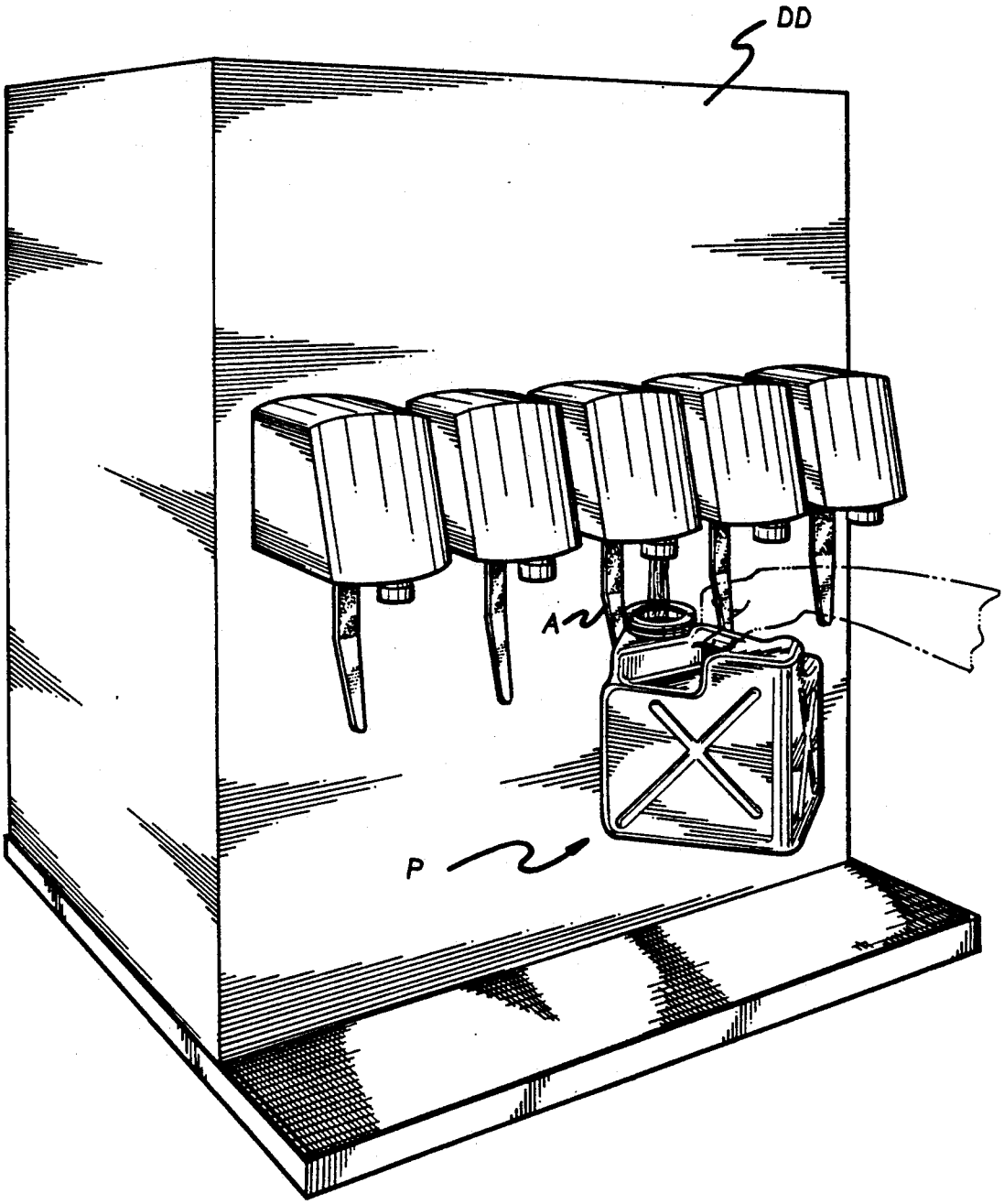
FIG. 8 is an elevational perspective view, showing the invention being filled with liquid from an otherwise conventional drink dispenser.

FIGS. 7 and 8 show the container P in use, with the chamfered or bevelled edge 70 engaging the activation lever A of a drink dispenser DD.

The invention as presently envisioned is to be made of a blow molded polyethylene material, but other materials could be used as they would occur to any one of normal skill in the art.

It is to be understood that the present invention is not limited to the plural embodiments described above, but encompasses any and all embodiments within the scope of the following claims.

I claim:

1. A container for liquids comprising:

planar side wall means for defining a container main body;

a planar bottom wall means integrally and perpendicularly connected to said side wall means, for defining a container bottom for said container main body;

a top wall means parallel to said bottom wall means, integrally and perpendicularly connected to said side wall means, for defining a container top for said container main body;

an open, hollow raised neck means for defining an offset fill and pour spout opening therethrough and communicating with the interior of said container main body, said raised neck means and spout being located on and perpendicular to said container top, proximate said container main body side wall means; and means defining a chamfered, bevelled nose section on said side wall means, adjacent to and intersecting with said hollow raised neck means and said spout, said nose section being dimensioned and configured to engage an activation means for dispensing liquid from an otherwise conventional liquid drink dispenser into said open, hollow raised neck means; whereby said container may be filled at said drink dispenser by pressing said chamfered, bevelled nose section against the liquid dispensing activation means of said dispenser.

2. The container for liquids according to claim 1, further comprising means defining a hollow, raised rear section on said container top wall means, integral therewith and located on said top wall means, generally opposite said hollow raised neck means.

3. The container for liquids according to claim 2, further comprising a hollow handle portion integral with and interconnecting said hollow raised neck means and said raised rear section, such that said handle portion is in fluid communication with both said raised rear section and said hollow raised neck means, said raised rear section and said hollow handle portion being arranged such that, upon filling of said container main body with liquid, the liquid rises to fill both said raised rear section and said hollow handle portion.

4. The container for liquids according to claim 3, said hollow handle portion and said container top wall means being arranged and configured to define an open, recessed, handle access area between said handle portion and said container top wall means, whereby said container may be grasped and held in a stable fashion from the top wall means of said container, to accurately direct liquid thereinto from a drink dispenser during a filling operation.

5. The container for liquids according to claim 3, wherein said container side wall means comprise four integrally connected side walls forming four corner side wall junctures, said hollow raised neck means being located adjacent one of said four corner side wall junctures, said chamfered, bevelled nose section being formed in said one of said four corner side wall junctures, immediately adjacent to and beneath said hollow raised neck means, said hollow handle portion being arranged diagonally across and over said top wall means.

6. The container for liquids according to claim 1, wherein said container side wall means comprise four integrally connected side walls forming four corner side wall junctures, said hollow raised neck means being located adjacent one of said four corner side wall junctures, said chamfered, bevelled nose section being formed in said one of said four corner side wall junctures, immediately adjacent to and beneath said hollow raised neck means.

7. The container for liquids according to claim 6, wherein at least one of said four integrally connected side walls further includes means defining a generally X-configured, strengthening and decorative rib pattern within said one wall, formed as a depression within said wall.

8. The container for liquids according to claim 7, wherein each of said four integrally connected side walls further includes said means defining a generally X-configured, strengthening and decorative rib pattern.

9. The container for liquids according to claim 6, there further being means defining an endless, lower peripheral edge lip in said side walls, entirely about said container, and adjacent said container bottom wall means.

10. The container for liquids according to claim 6, there further being means defining an endless, upper peripheral edge lip in said side walls, entirely about said container, and adjacent said container top wall means.

11. The container for liquids according to claim 6, there further being means defining an endless, lower peripheral edge lip in said side walls, entirely about said container, and adjacent said container bottom wall means, and means defining an endless, upper peripheral edge lip in said side walls, entirely about said container, and adjacent said container top wall means.

12. The container for liquids according to claim 1, there further being means defining an endless, lower peripheral edge lip in said side wall means, entirely about said container, and adjacent said container bottom wall means.

13. The container for liquids according to claim 1, there further being means defining an endless, upper peripheral edge lip in said side wall means, entirely about said container, and adjacent said container top wall means.

14. The container for liquids according to claim 1, there further being means defining an endless, lower peripheral edge lip in said side wall means, entirely about said container, and adjacent said container bottom wall means, and means defining an endless, upper peripheral edge lip in said side walls means, entirely about said container, and adjacent said container top wall means.

* * * * *